US005482301A

United States Patent [19]

Babcock

[11] Patent Number: 5,482,301

[45] Date of Patent: Jan. 9, 1996

[54] SELF LEVELING IN-LINE SKATE BRAKE

[76] Inventor: Martin Babcock, 2214 Tower Ct., Woodbury, Minn. 55125

[21] Appl. No.: 324,589

[22] Filed: Oct. 18, 1994

Related U.S. Application Data

[63] Continuation-in-part of Ser. No. 146,529, Nov. 1, 1993, which is a continuation-in-part of Ser. No. 969,980, Nov. 2, 1992, Pat. No. 5,257,795.

[51] Int. Cl.[6] ..... A63C 17/14

[52] U.S. Cl. ..... 280/11.2; 280/11.22

[58] Field of Search ..... 280/11.2, 11.21, 280/11.22, 11.23, 11.27, 87.042; 188/5, 25

[56] References Cited

U.S. PATENT DOCUMENTS

| | | | |
|---|---|---|---|
| 334,739 | 1/1886 | Blum | 280/11.2 |
| 894,501 | 7/1908 | Hohenadel | 280/11.2 |
| 2,551,122 | 5/1951 | Hayner | 280/11.2 |
| 2,691,532 | 10/1954 | Hayner | 280/11.2 |
| 3,287,023 | 11/1966 | Ware | 280/11.2 |
| 4,181,227 | 1/1980 | Balstad | 280/11.2 |
| 5,028,058 | 7/1991 | Olson | 280/11.2 X |
| 5,253,883 | 10/1993 | Moldenhauer | 280/11.22 X |
| 5,257,795 | 11/1993 | Babcock | 280/11.22 X |
| 5,299,815 | 4/1994 | Brosnan et al. | 188/5 X |

*Primary Examiner*—Brian L. Johnson
*Attorney, Agent, or Firm*—D. L. Tschida

[57] ABSTRACT

A braking system for in-line skates including a skid pad. The skid pad is mounted to transversely pivot within a support bracket or track housing and adjust to ankle cant of a skater. A spring at the skid pad mates to a tapered socket at the bracket to center the pad to the bracket. Side limits prevent over rotation of the skid pad. Insert molded and multi-section skid pad assemblies are disclosed.

15 Claims, 6 Drawing Sheets

SELF LEVELING IN-LINE SKATE BRAKE

This is a continuation application of application Ser. No. 08/146,529, filed Nov. 1, 1993, which is a continuation-in-part of Ser. No. 969,980, filed Nov. 2, 1992, U.S. Pat. No. 5,257,795.

BACKGROUND OF THE INVENTION

The present invention relates to skate brake systems and, in particular, to a system which is adaptable without appreciable modification to in-line skates.

With the expanding popularity of in-line skates, growing numbers of injuries have occurred as a consequence of the braking inefficiencies of such skates. The severity and potential of such injuries is heightened due to the typical concrete or asphalt rolling surface.

Although protective safety padding and clothing is normally worn, a need exists for an improved braking system. Such a system should be capable of accommodating a range of conditions from normal maneuvering to emergency braking. The brake system should assure maximum contact between the skid pad and ground over the life of the skid pad. Optimal braking can thereby be achieved without skidding or loss of control.

Available brake systems principally provide a high durometer elastomer skid pad, which is rigidly mounted to the toe or heel of a skate at the wheel track. Brake action is obtained by dragging or skidding the pad with an appropriate shifting of body weight over the skating surface to increase friction and slow skater momentum. A skater may also slow momentum by dragging the edges of one or more wheels of a trailing skate along the ground surface.

Although such mechanisms and techniques slow the skater's momentum, depending upon the ground surface, the skid pad or wheels may be prematurely damaged and require replacement. The skid pad may wear unevenly, resulting in skidding or intermittent braking action, which may destabilize the skater.

Uneven skid pad wear also frequently results from the propensity of rollerbladers to cant or tip their ankles during stopping. As the angle of cant changes or undulations are encountered in the terrain, contact between the unevenly worn braking surface of the skid pad and ground is affected. A reduced contact surface lessens braking efficiency.

Solutions to the above problems must consider the materials and the dynamics of skating and the necessity of not only stopping the skater, but also maintaining skater stability through the stopping action. Other considerations relate to increasing the surface area of frictional contact, selection and placement of friction enhancing materials and the wear characteristics, cost and ease of replacement of any brake assembly.

In addition to skid pads, a variety of brake systems have been developed for application to traditional roller skates, skate boards and in-line skates. Some of such systems are disclosed in U.S. Pat. Nos. 5,067,736; 5,053,102; 5,028,058; 4,909,523; 4,453,726; 4,275,895; and 3,884,486.

Another brake assembly having braking surfaces which contact the wheel and terrain is shown at U.S. Pat. No. 5,257,795. The assembly includes a skid pad that rotates at a pivot axle at the track housing, but which like all other known assemblies does not accommodate canting of the track housing to prevent uneven wear at the skid pad.

In distinction to known in-line skate brake systems, the present invention provides an assembly which reduces the likelihood of uneven lateral skid pad wear.

SUMMARY OF THE INVENTION

It is accordingly a primary object of the invention to provide a wheeled skate braking system which accommodates ankle cant and prevents uneven lateral wear at a skid pad.

It is a further object of the invention to provide a brake system which includes a ground engaging skid pad that is mounted to laterally pivot.

It is a further object of the invention to provide a pivoting skid pad which is biased to a center equilibrium at a support housing or bracket.

It is a further object of the invention to provide a support housing or bracket that cooperates with the skid pad to limit left and right rotation.

Various of the foregoing objects, advantages and distinctions are particularly obtained in a presently preferred construction of the invention which provides a bracket that mounts to the aft end of a wheel support track assembly or which is integrally incorporated into the wheel track. A skid pad is mounted to the bracket to laterally pivot about an axle.

A flat spring projects from the skid pad and cooperates with a groove at the support bracket to center the pad to the bracket. The spring counter balances lateral misalignment of the pad from a preferred perpendicular axis. Shoulders of the bracket limit left and right pad rotation.

Still other objects, advantages and distinctions of the invention are apparent from the following description with respect to the appended drawings. Although the invention is described in relation to presently preferred constructions and considered modifications and improvements thereto, the description should not be interpreted in strict limitation to the disclosure. Rather, the invention should be interpreted within the range of equivalent structures disclosed and claimed in the appended claims.

DESCRIPTION OF PREFERRED EMBODIMENTS

Figure 1:
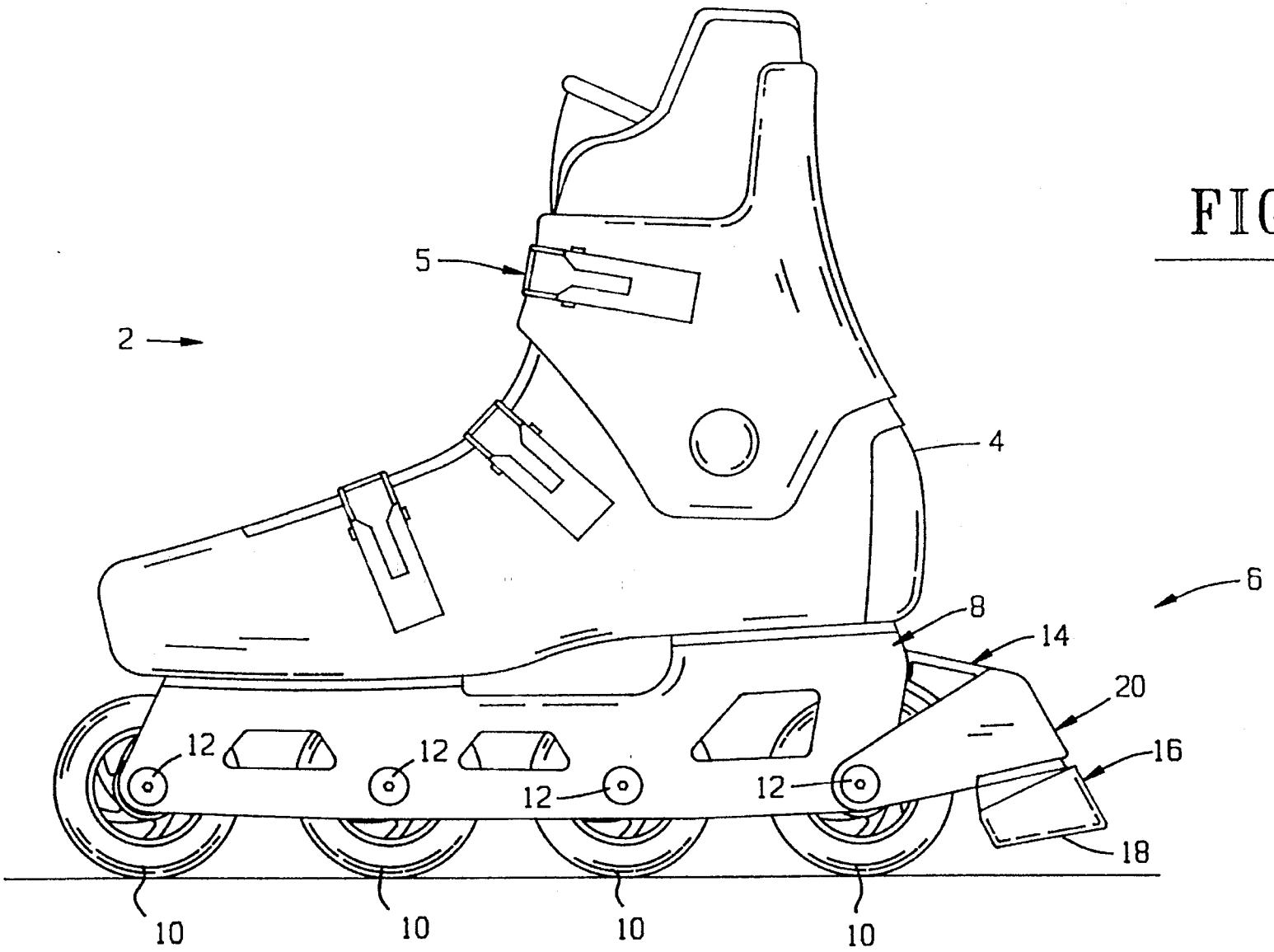
FIG. 1 is an elevation drawing of an in-line skate that includes a skid pad which laterally adjusts to accommodate ankle cant.

Turning attention to FIG. 1, an elevation drawing is provided to a conventional in line skate 2. The skate 2 principally comprises a boot 4 that is retained to a skater's foot with a number of buckle retainers 5. A track assembly 6 is secured to the bottom of the boot 4.

The track assembly 6 includes a channeled track housing 8 having a pair of displaced side walls that support a number of wheels 10. Each of the wheels 10 are aligned to one another along the track housing 8 and supported at an axle 12.

A brake assembly 14 is secured to the aft end of the housing 8 and supports a skid pad 16. During normal braking, the toe of the boot 4 is raised to pivot the skate 2 rearward about the aft wheel 10 and cause the skid pad 16 to engage the ground, provide friction and stop the skater.

Most commercially available skid pads rigidly mount either to a bracket that extends from the track housing 8 or directly to the track housing 8. Some pads also mount to brake assemblies that longitudinally pivot at a pivot transverse relative to the track housing 8, for example, see U.S. Pat. No. 5,257,795.

Figure 5:
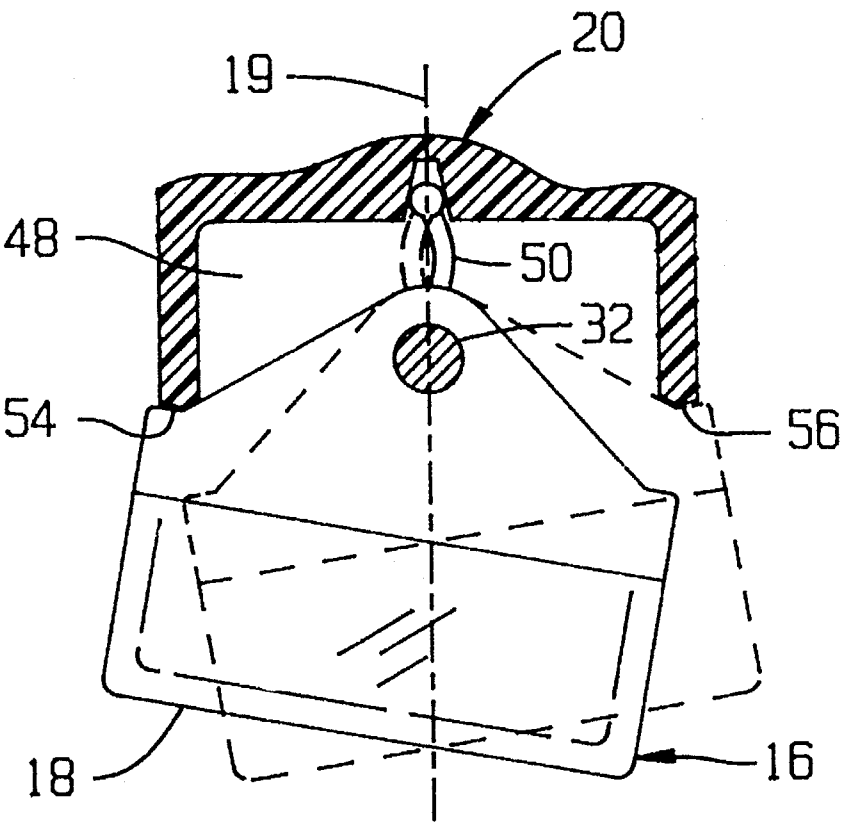
FIG. 5 is a partial cross section drawing showing the relative lateral movement of the skid pad to right and left limits at the support bracket.

Over time and with pad wear, the ground contact surface 18 of the pad 16 frequently demonstrates uneven wear. Such wear principally arises from the skater canting his or her ankle and lower leg relative to a plumb axis 19 through the pivot axle 32, reference FIG. 5. That is, most skaters do not stand perfectly erect during braking and instead laterally cant the skate 2 slightly in or out, as shown in dashed and solid line at the skid pad 16, which translates to a corresponding canting of the brake surface 18 and uneven lateral wear at the brake surface 18. In the event the skater does not always cant his or her ankles the same, all regions of the surface 18 do not evenly contact the ground, which produces less than efficient braking.

In appreciation of the foregoing deficiency, the skid pad 16 is mounted to pivot laterally to maintain a normal alignment to the plumb axis 19 and the terrain. In spite of skate cant, the brake surface 18 is thereby maintained normal to the plumb axis 19, parallel to and in uniform contact with the terrain. Uneven lateral pad wear is thereby avoided.

Although the invention is described with respect to a rigid track housing and pad mounting, the pad 16 can be mounted to a brake assembly which longitudinally pivots at a pivot transverse to the track housing, for example, as described in U.S. Pat. No. 5,257,795. Particular details to the mounting of alternative constructions of the skid pad 16 and mounting to the brake assembly 14 are shown at FIGS. 2–7.

Figure 2:
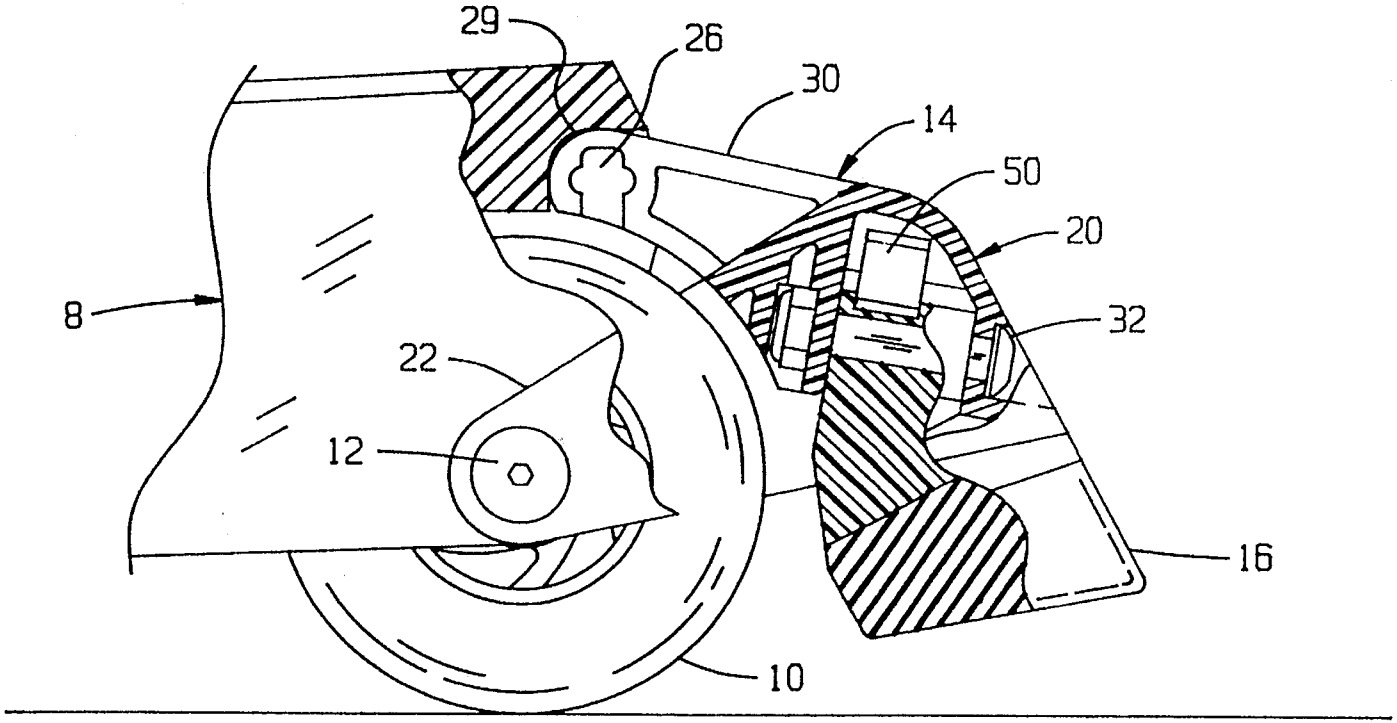
FIG. 2 is a cutaway view shown in partial cross section through the skid pad bracket of FIG. 1.
Figure 3:
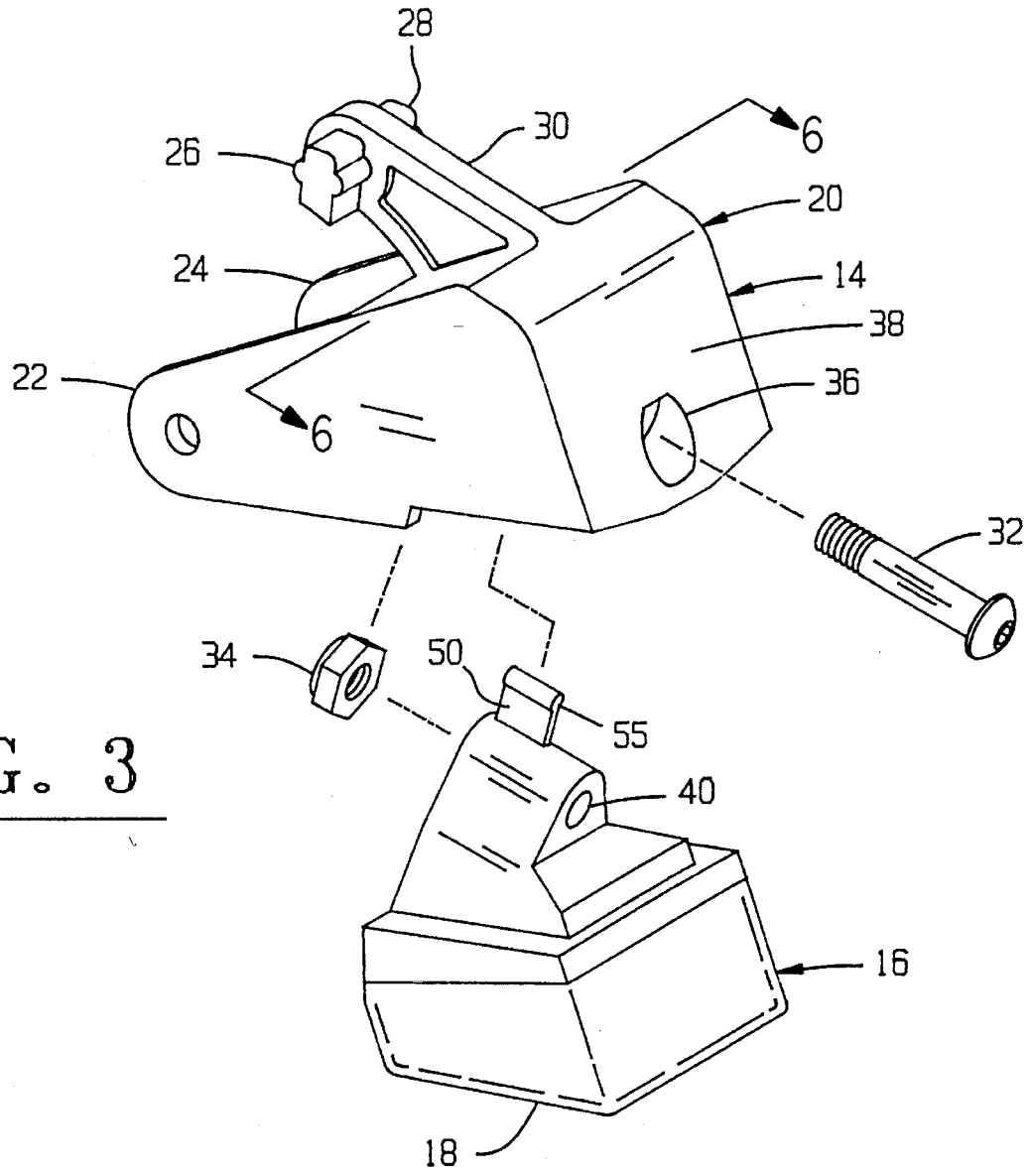
FIG. 3 is a perspective drawing shown in exploded assembly of the skid pad bracket and skid pad.
Figure 4:
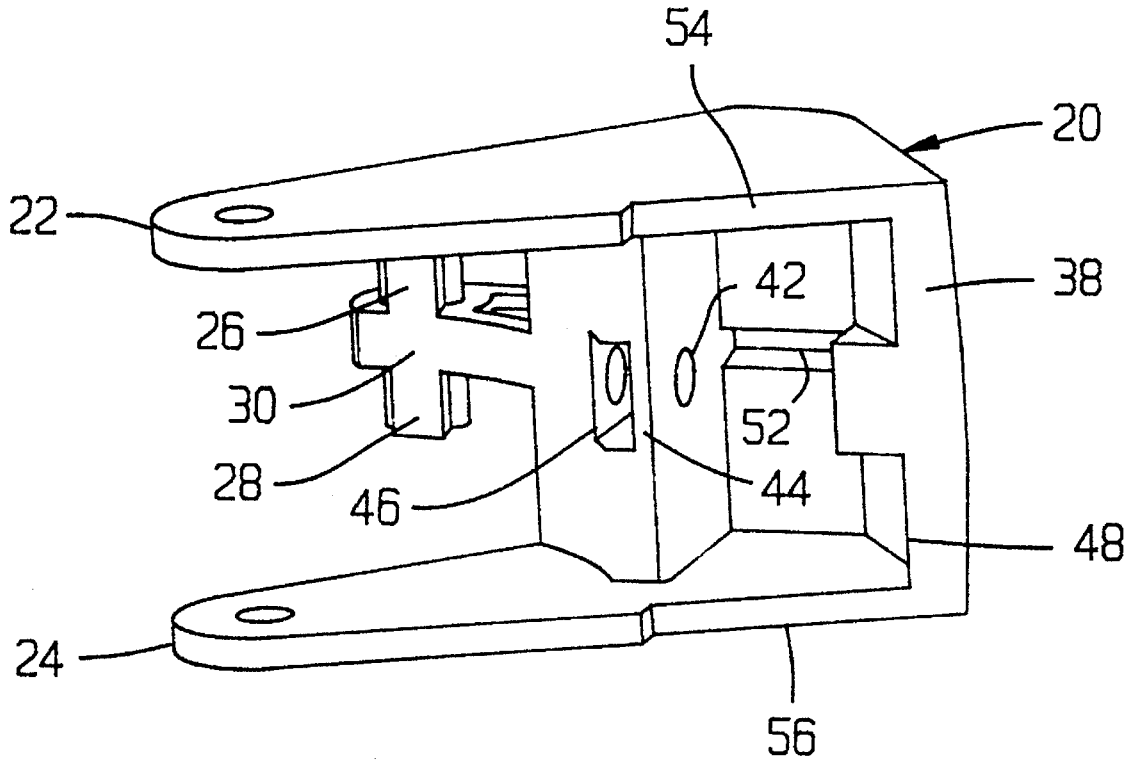
FIG. 4 is a perspective drawing of the skid pad bracket, without the skid pad, and viewed from the bottom.

With attention to FIG. 2, an elevation drawing is shown of the brake assembly 14 in partial section. FIG. 3 shows an exploded assembly drawing of the brake assembly 14 with respect to an insert molded skid pad 16. Further details to a skid pad support bracket 20 and the mounting and pivotal movement of the skid pad 16 at the bracket 20 are respectively shown at FIGS. 4–6. FIG. 7 shows a further exploded assembly drawing of a multi-section skid pad assembly 21.

The support bracket 20 is retained to the track housing 8 at two points. The axle 12 of the aft or rear most wheel 10 contains a pair of flange arms 22 and 24 that project from the bracket 20 to the housing 8. Flanges 26 and 28 at a projecting brace arm 30 separately retain and brace the bracket 20 to the track housing 8 at a mating socket 29. The skid pad bracket 20 is thus rigidly retained at two points to the track housing 8.

In lieu of a separate support bracket 20, the bracket 20 can be integrally incorporated into the track housing 8. If so constructed, the bracket 20 would be integrally molded to project from the aft end of the housing 8. Necessary cavities and appendages would be included to pivotally support the skid pad 16 in a comparable fashion to that described below.

The skid pad 16 is supported to the bracket 20 at a threaded pivot bolt 32 and nut fastener 34. The bolt 32 mounts through an aperture 36 at a rear bracket wall 38, through an aperture 40 in the pad 16 and an aperture 42 at an interior bracket wall 44. The nut 34 mounts within a cavity 46 and the skid pad 16 is supported at a cavity 48. The cavity 48 is sized in relation to the pad 16 to permit the pad 16 to pivot laterally or transversely to either side of a center or equilibrium position defined by the cooperation of a spring member 50 and an internal cavity 52. Pad rotation to either side is limited by surfaces 54 and 56 at the bracket 20, reference FIG. 5. The surfaces 54, 56 act as stops.

The pad 16 is centered to the bracket 20 via the cavity 52. An end 55 of the spring 50 is retained between tapered walls 57 and 59 of the cavity 52. Any canting of the track housing 8 and pad 16 during braking, induces the spring 50 to flex to resist pad rotation. The pad 16, however, is free to rotate between the limits set by the surfaces 54, 56 and accommodate the canted angle of the skate 2. The limits of pad rotation are shown in solid and dashed line in FIG. 5.

Regardless of the angle of cant, provided the cant is within the rotation limits of the assembly 14 (e.g. plus/minus 10 to 15 degrees) uniform contact is maintained between the surface 18 and terrain. Uneven wear is thereby avoided at the surface 18 and a skater is assured of uniform braking regardless of variations in the cant angle with each braking event.

Figure 6:
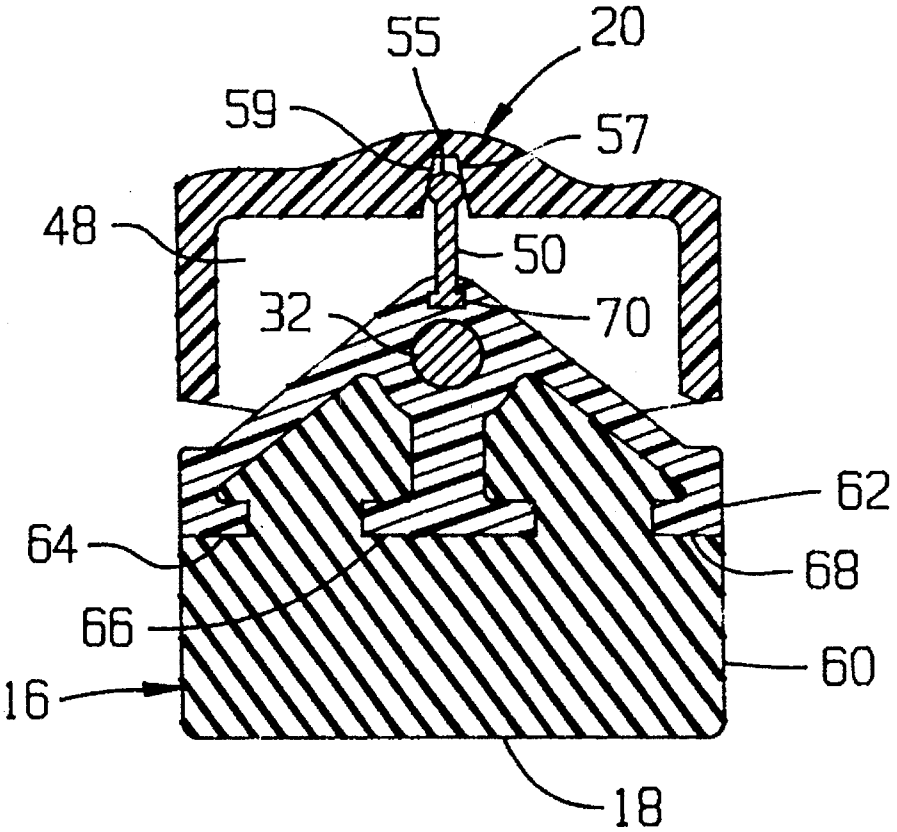
FIG. 6 is a cross section drawing taken along section lines 6—6 of FIG. 3 through the skid pad.
Figure 7:
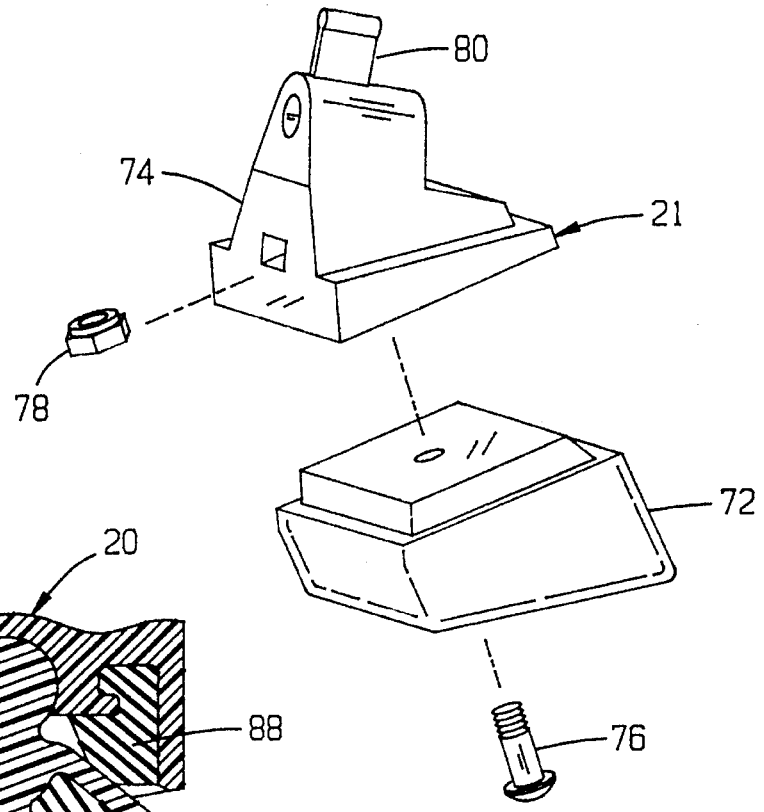
FIG. 7 is a perspective drawing shown in exploded assembly of a multi-section skid pad.

Referring to FIG. 6, a cross section view is shown through the skid pad 16. The pad 16 is constructed using insert molding techniques to provide an elastomer pad 60 which is molded to a plastic cap piece 62. A number of flanges 64, 66 and 68 retain the pad 60 and cap piece 62 to one another.

A flat leaf spring 50 projects from and is retained to the cap piece 62 which separate flanges 70. The resilience of the spring 50 can be controlled through material selection and by varying the vertical height of the spring 50. Although the spring 50 is insert molded into the cap piece 62, it can also be integrally constructed with the cap piece 62.

FIG. 7 depicts the assembly of the multi-section skid pad assembly 21. The pad assembly 21 includes an elastomer ground pad 72 which is retained to a cap piece 74 with mating bolt and nut fasteners 76, 78. A spring 80 projects from the cap piece 74. The spring 80 can be integrally molded as part of the cap piece or molded as a separate insert.

Although preferred vertical springs 50 and 80 are shown, still other arrangements can be provided to bias the pad assemblies 16 or 21 to the center equilibrium position. For example, additional resilient members can project from the skid pads or alternatively one or more resilient members can project into the cavity 48 from the walls of the support bracket 20. Alternative limits or stops may also be formed as enlarged surfaces at the bracket 20 or cap pieces 62 and 74 in lieu of the surfaces 54, 56. The entire cavity 48 may also be filled with a resilient filler material.

Figure 8:
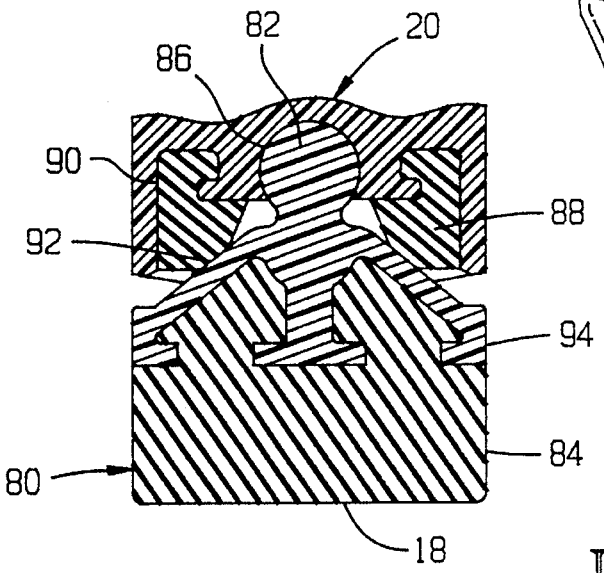
FIG. 8 is a cross section drawing showing a ball-and-socket brake assembly having a brake pad which is capable of rotation over multiple axes.

In the latter regard, FIG. 8 depicts yet another construction of a brake assembly 80 that is capable of pivoting over 360 degrees about the plumb axis, when viewed from above. The assembly 80 can be incorporated into a rigid mount or a longitudinally pivoting brake system. The multi-axis rotation is obtained at a ball-like member 82 that projects from a skid pad 84. The member 82 mates with a socket 86 provided at the bracket 20. A resilient elastomer filler 88 is included at a cavity 90 between the member 82 and bracket 20. A shoulder 92 at the filler contacts a cap piece 94 and biases the pad 84 to the equilibrium position, yet flexes with pad movement to accommodate longitudinal and lateral canting of the track housing by the skater and maintain even wear at the brake surface 18.

Although a ball and socket type mounting is shown, varieties of different shaped appendages and mating sockets can be incorporated at the skid pad, bracket 20 or track housing 8.

While the invention has been described with respect to presently preferred assemblies and considered modifications and improvements, still other equivalent structures may be suggested to those skilled in the art. The invention should therefore be interpreted to include all those equivalent embodiments within the spirit and scope of the appended claims.

What is claimed is:

1. Skate braking apparatus comprising:

a) a support frame including a plurality of wheels aligned seriatim between sidewalls of the support frame and along a longitudinal axis of the support frame; and (b) a skid pad having a terrain contacting brake surface, wherein said skid pad is mounted to said support frame and to a pivot having a pivot axis coaxial to the longitudinal axis such that the skid pad can rotate about the pivot to maintain said brake surface parallel to the terrain and normal to a plumb axis to the terrain and through said pivot and independent of a cant angle of said frame from the plumb axis, whereby the brake surface uniformly engages the terrain without incurring uneven wear at the brake surface.

2. Apparatus as set forth in claim 1 including stop means for limiting rotation of said skid pad relative to the cant angle of said frame.

3. Apparatus as set forth in claim 1 including:

(a) a bracket mounted to said frame to a first pivot having a pivot axis transverse to the longitudinal axis of the frame and including a second pivot having a pivot axis coaxial to the longitudinal axis of said frame;

(b) means for retaining the bracket to the frame; and (c) wherein said skid pad is mounted to said first axis to longitudinally pivot the skid pad and to the second axis to laterally pivot the skid pad to accommodate side-to-side canting of said frame.

4. Apparatus as set forth in claim 3 wherein a resilient member projects from said skid pad to contact surfaces of said bracket to bias said skid pad to an equilibrium position centered to said frame.

5. Apparatus as set forth in claim 4 wherein said resilient member projects from said skid pad and mounts within a cavity of said bracket, and wherein said cavity includes tapered walls which bias said skid pad to an equilibrium position centered to said frame.

6. Apparatus as set forth in claim 4 wherein first and second stop surfaces of said bracket limit lateral rotation of said skid pad.

7. Apparatus as set forth in claim 4 wherein said skid pad includes a cap piece and a ground pad secured to said cap piece, and wherein surfaces of said bracket contact said cap piece to limit rotation of said skid pad.

8. Apparatus as set forth in claim 4 wherein said skid pad comprises a cap piece, a ground pad, and fastener means for retaining said ground pad to said cap piece, and wherein said second pivot comprises an axle which supports said skid pad to said bracket.

9. Skate braking apparatus comprising:

(a) a support frame including a plurality of wheels aligned seriatim between sidewalls of the support frame and along a longitudinal axis of the support frame;

(b) a bracket mounted to said frame at a first pivot having a pivot axis transverse to the longitudinal axis of the frame and including an axle mounted coaxial to the longitudinal axis of said frame; and (c) a skid pad mounted to said bracket having a brake surface and a resilient member which projects to contact surfaces of said bracket to bias said skid pad to an equilibrium position, and wherein said skid pad is mounted to a pivot having a pivot axis coaxial to the longitudinal axis to rotate and maintain said brake surface parallel to the terrain and normal to a plumb axis to the terrain through said axle and independent of a cant angle of said frame from the plumb axis., whereby the brake surface uniformly engages the terrain without incurring uneven wear at the brake surface.

10. Apparatus as set forth in claim 9 wherein first and second stop surfaces of said bracket limit lateral rotation of said skid pad.

11. Apparatus as set forth in claim 10 wherein said resilient member which projects from said skid pad mounts within a cavity of said bracket.

12. Apparatus as set forth in claim 9 wherein said skid pad includes a cap piece having plurality of projecting surfaces which are integrally molded into said skid pad.

13. Skate braking apparatus comprising:

(a) a support frame including a plurality of wheels aligned seriatim between sidewalls of the support frame and along a longitudinal axis of the support frame;

(b) a skid pad having a brake surface; and a support member fastened to said frame, an axle mounted coaxial to the longitudinal axis of said frame to support said skid pad to said support member to laterally pivot and maintain said brake surface parallel to the terrain and independent of a cant angle of said frame from a plumb axis to the terrain, whereby the brake surface uniformly engages the terrain without incurring uneven wear at the brake surface.

14. Skate braking apparatus comprising:

a) a support frame including a plurality of wheels aligned seriatim between sidewalls of the support frame and along a longitudinal axis of the support frame; and (b) a skid pad having a terrain contacting brake surface, wherein said skid pad is mounted to said support frame at an axle having a pivot axis coaxial to the longitudinal axis to laterally pivot such that the skid pad can rotate about the axle to maintain said brake surface parallel to the terrain and normal to a plumb axis to the terrain through said pivot and independent of a cant angle of said frame from the plumb axis, whereby the brake surface uniformly engages the terrain without incurring uneven wear over the brake surface.

15. Skate braking apparatus comprising:

(a) a support frame including a plurality of wheels aligned seriatim between the sidewalls of the support frame and along a longitudinal axis of the support frame;

(b) a bracket mounted to said frame at a first pivot having a pivot axis transverse to the longitudinal axis of the frame and including an axle mounted coaxial to the longitudinal axis of said frame; and (c) a skid pad mounted to said bracket having a brake surface and a resilient member which projects from said skid pad to mount within a cavity of said bracket to bias said skid pad to an equilibrium position, and wherein said skid pad is mounted to a pivot to rotate and maintain said brake surface parallel to the terrain and normal to a plumb axis to the terrain through said axle and independent of a cant angle of said frame from the plumb axis, whereby the brake surface uniformly engages the terrain without incurring uneven wear at the brake surface.

* * * * *